US006808679B2

(12) United States Patent
Pekguleryuz et al.

(10) Patent No.: US 6,808,679 B2
(45) Date of Patent: Oct. 26, 2004

(54) MAGNESIUM-BASED CASTING ALLOYS HAVING IMPROVED ELEVATED TEMPERATURE PERFORMANCE, OXIDATION-RESISTANT MAGNESIUM ALLOY MELTS, MAGNESIUM-BASED ALLOY CASTINGS PREPARED THEREFROM AND METHODS FOR PREPARING SAME

(75) Inventors: Mihriban Ozden Pekguleryuz, Pointe-Claire (CA); Pierre Labelle, St-Hyppolyte (CA); Pierre Vermette, Pierrefonds (CA)

(73) Assignee: Noranda, Inc., Toronto (CA)

( * ) Notice: Subject to any disclaimer, the term of this patent is extended or adjusted under 35 U.S.C. 154(b) by 149 days.

(21) Appl. No.: 09/995,086

(22) Filed: Nov. 27, 2001

(65) Prior Publication Data

US 2002/0104593 A1 Aug. 8, 2002

Related U.S. Application Data

(63) Continuation-in-part of application No. 09/461,538, filed on Dec. 15, 1999, now Pat. No. 6,322,644.

(51) Int. Cl.[7] ..... C22C 23/02

(52) U.S. Cl. ..... 420/407; 420/408; 75/594; 75/600

(58) Field of Search ..... 420/407, 408, 420/409; 75/594, 600; 148/420

(56) References Cited

U.S. PATENT DOCUMENTS 4,659,377 A 4/1987 Foerster
5,693,158 A * 12/1997 Yamamoto et al. ..... 148/557
5,983,976 A * 11/1999 Kono ..... 164/113
6,264,763 B1 7/2001 Powell et al.
6,283,197 B1 9/2001 Kono
6,322,644 B1 * 11/2001 Pekguleryuz et al. ..... 148/420
6,342,180 B1 * 1/2002 Lefebvre et al. ..... 420/407

* cited by examiner

*Primary Examiner*—Daniel Jenkins
(74) *Attorney, Agent, or Firm*—Holland & Bonzagni, P.C.; Mary R. Bonzagni, Esq.

(57) ABSTRACT

A magnesium-based casting alloy having good salt-spray corrosion resistance and improved creep resistance, tensile yield strength and bolt-load retention, particularly at elevated temperatures of at least 150° C., is provided. The inventive alloy comprises, in weight percent, 2 to 9% aluminum and 0.5 to 7% strontium, with the balance being magnesium except for impurities commonly found in magnesium alloys.

A method of making an oxidation-resistant alloy melt, and the alloy melt prepared by such a method, are also provided. The alloy melt comprises magnesium as a primary alloying metal, and aluminum and strontium as secondary alloying metals, while the inventive method comprises: melting the alloying metals under an atmosphere of an inert gas selected from a mixture of carbon dioxide and sulfur fluoride gas, a mixture of nitrogen and sulfur dioxide gas, and combinations thereof.

Further provided is a method of making a magnesium-based alloy casting from the above-identified alloy melt, and the alloy casting prepared by such a method.

9 Claims, 4 Drawing Sheets

MAGNESIUM-BASED CASTING ALLOYS HAVING IMPROVED ELEVATED TEMPERATURE PERFORMANCE, OXIDATION-RESISTANT MAGNESIUM ALLOY MELTS, MAGNESIUM-BASED ALLOY CASTINGS PREPARED THEREFROM AND METHODS FOR PREPARING SAME

RELATED APPLICATION

This application is a continuation-in-part of U.S. patent application Ser. No. 09/461,538, filed Dec. 15, 1999, now U.S. Pat. No. 6,322,644, which is incorporated herein by reference.

FIELD OF THE INVENTION

The present invention generally relates to magnesium-based casting alloys having improved elevated temperature performance and more particularly relates to magnesium-aluminum-strontium alloys having good salt-spray corrosion resistance and good creep resistance, tensile yield strength and bolt-load retention, particularly at elevated temperatures of at least 150° C. The present invention also relates to a method of making an oxidation-resistant magnesium alloy melt and to a method of making a magnesium-based alloy casting from such an oxidation-resistant alloy melt. The present invention further relates to the oxidation-resistant alloy melt and alloy casting prepared by such methods.

BACKGROUND OF THE INVENTION

Magnesium-based alloys have been widely used as cast parts in the aerospace and automotive industries and are mainly based on the following four systems:

Mg—Al system (i.e., AM20, AM50, AM60);

Mg—Al—Zn system (i.e., AZ91D);

Mg—Al—Si system (i.e., AS21, AS41); and

Mg—Al—Rare Earth system (i.e., AE41, AE42).

Magnesium-based alloy cast parts can be produced by conventional casting methods which include diecasting, sand casting, permanent and semi-permanent mold casting, plaster-mold casting and investment casting.

These materials demonstrate a number of particularly advantageous properties that have prompted an increased demand for magnesium-based alloy cast parts in the automotive industry. These properties include low density, high strength-to-weight ratio, good castability, easy machineability and good damping characteristics.

AM and AZ alloys, however, are limited to low-temperature applications where they are known to lose their creep resistance at temperatures above 140° C. AS and AE alloys, while developed for higher temperature applications, offer only a small improvement in creep resistance and/or are expensive.

It is therefore an object of the present invention to provide relatively low cost magnesium-based alloys with improved elevated-temperature performance.

It is a more particular object to provide relatively low cost magnesium-aluminum-strontium alloys with good creep resistance, tensile yield strength and bolt-load retention, particularly at elevated temperatures of at least 150° C., and good salt-spray corrosion resistance.

It is a further object to provide oxidation-resistant alloy melts and magnesium-based alloy castings, prepared therefrom.

SUMMARY OF THE INVENTION

The present invention therefore provides a magnesium-based casting alloy comprising, in weight percent, 2 to 9% aluminum and 0.5 to 7% strontium with the balance being magnesium except for impurities commonly found in magnesium alloys.

The present invention also provides a method of making an oxidation-resistant alloy melt, and the alloy melt prepared by such a method. The alloy melt comprises magnesium as a primary alloying metal, and aluminum and strontium as secondary alloying metals, while the inventive method comprises: melting the alloying metals under an atmosphere of an inert gas selected from a mixture of carbon dioxide and sulfur fluoride gas, a mixture of nitrogen and sulfur dioxide gas, and combinations thereof.

The present invention further provides a method of making a magnesium-based alloy casting from the above-identified alloy melt, and the alloy casting prepared by such a method.

The foregoing and other features and advantages of the present invention will become more apparent from the following description and accompanying drawings.

BRIEF DESCRIPTION OF THE DRAWINGS

Particular features of the disclosed invention are illustrated by reference to the accompanying drawings in which.

DETAILED DESCRIPTION OF THE PREFERRED EMBODIMENT

Figure 1:
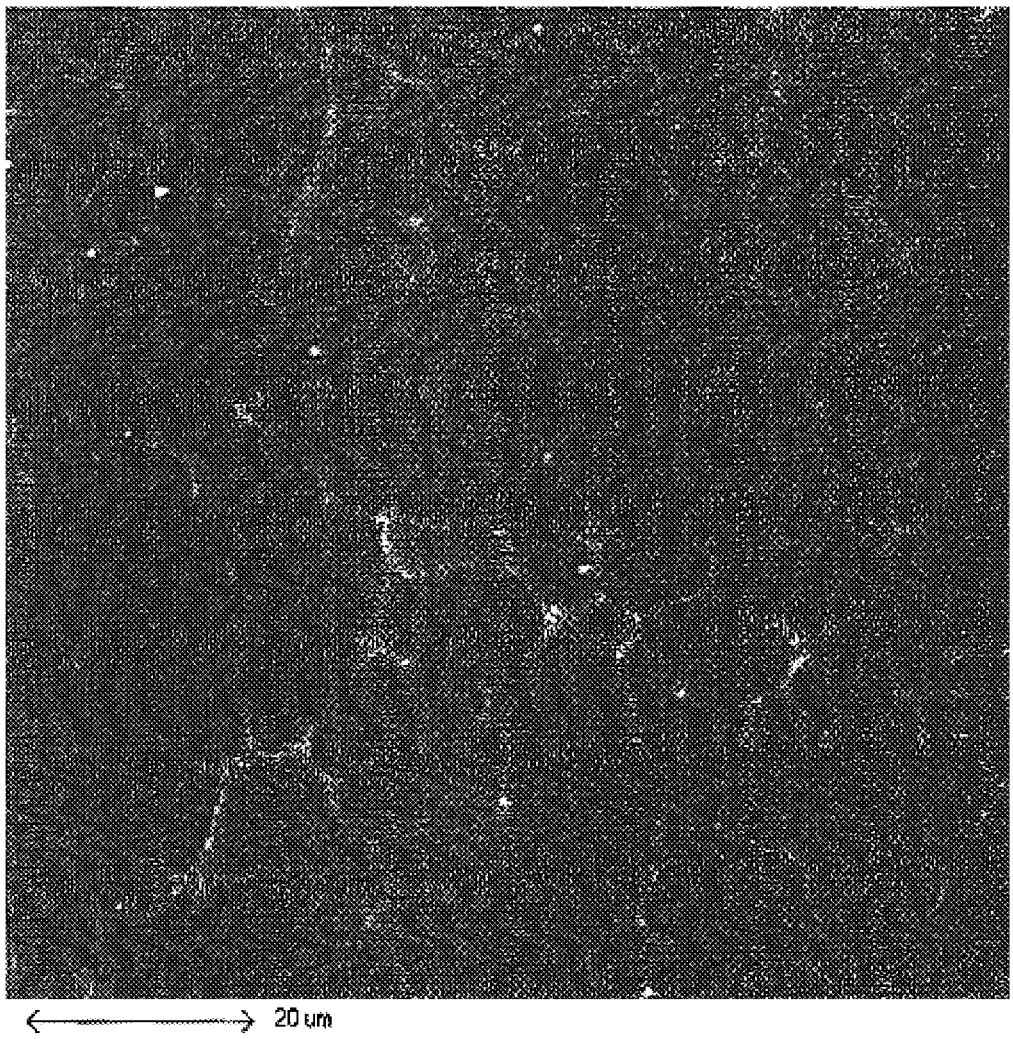
FIG. 1 is a photomicrograph showing the microstructure of a diecast alloy of the present invention, hereinafter referred to as alloy A1.

The magnesium-based casting alloys of the present invention are relatively low cost alloys that demonstrate improved creep resistance, tensile yield strength and bolt-load retention at 150° C. The inventive alloys also demonstrate good salt-spray corrosion resistance.

As a result of the above-identified properties, the inventive alloys are suitable for use in a wide variety of applications including various elevated temperature automotive applications such as automotive engine components and housings for automotive automatic transmissions.

The inventive alloys generally will have a preferred average % creep deformation at 150° C. of ≦0.06% for diecast alloys and ≦0.03% for permanent-mold cast alloys. In addition, the alloys generally will have an average bolt-load-loss (measured as additional angle to re-torque) at 150° C. of ≦6.3° for alloys in the diecast state and ≦3.75° for alloys in the permanent-mold cast state.

In regard to tensile properties, the inventive alloys will generally have an average tensile yield strength (ASTM E8-99 and E21-92 at 150° C.) of >100 megapascals (MPa) for diecast alloys and >57MPa for permanent-mold cast alloys.

The average resistance of the inventive alloys to salt-spray corrosion, when measured in accordance with ASTM B117, is preferably ≦0.155 milligrams per square centimeter per day ($mg/cm^2/day$) for alloys in the diecast state.

In general, the magnesium-based alloys of the present invention are 100% crystalline alloys that contain, in weight percent, 2 to 9% aluminum and 0.5 to 7% strontium, with the balance being magnesium. Main impurities commonly found in magnesium alloys, namely—iron (Fe), copper (Cu) and nickel (Ni), are preferably kept below the following amounts(by weight): Fe≦0.004%; Cu≦0.03%; and Ni≦0.001% to ensure good salt-spray corrosion resistance.

In addition to the above components, the alloys of the present invention may contain the elements manganese (Mn) and/or zinc (Zn) in the following proportions (by weight): 0–0.60% Mn; and 0–0.35% Zn.

In a preferred embodiment, the inventive magnesium-based alloys contain, in weight percent, 4 to 6% aluminum, 1 to 5% strontium (more preferably 1 to 3%), 0.25 to 0.35% manganese and 0 to 0.1% zinc, with the balance magnesium. In yet a more preferred embodiment, the inventive alloys contain, in weight percent, 4.5 to 5.5% aluminum, 1.2 to 2.2% strontium, 0.28 to 0.35% manganese and 0 to 0.05% zinc, with the balance magnesium.

The inventive alloys may advantageously contain other additives provided any such additives do not adversely impact upon the elevated temperature performance and salt-spray corrosion resistance of the inventive alloys.

The inventive alloy can be produced by conventional casting methods which include diecasting, permanent and semi-permanent mold casting, sand-casting, squeeze casting and semi-solid casting and forming. It is noted that such methods involve solidification rates of $<10^2$K/sec.

In a preferred embodiment, the alloy of the present invention is prepared by melting a magnesium alloy (e.g., AM50), stabilizing the temperature of the melt between 675 and 700° C., adding a strontium aluminum master alloy (e.g., 90-10 Sr—Al master alloy) to the melt and then casting the melt into a die cavity using either diecasting or permanent mold casting techniques.

In a more preferred embodiment, the magnesium alloy melt of the present invention is protected against oxidation by surrounding or blanketing the melt with an atmosphere of an inert gas. The inert gas is selected from a mixture of carbon dioxide ($CO_2$) and sulfur fluoride ($SF_6$) gas, a mixture of nitrogen ($N_2$) and sulfur dioxide ($SO_2$) gas, and combinations thereof. The present inventors have made the surprising discovery that the magnesium alloy melt of the present invention demonstrates a resistance to oxidation that is higher than that demonstrated by commercial magnesium alloy melts (e.g., AZ91D alloy melts), when the melts are prepared in the protective-gas atmosphere described above.

The microstructure of the alloys obtained is described as follows. The matrix is made up of grains of magnesium having a mean particle size of from about 10 to about 200 micrometers (μm) (preferably from about 10 to about 30 μm for alloys in the diecast state and greater than 30 μm for alloys in the permanent mold cast state). The matrix is reinforced by precipitates of intermetallic compounds dispersed homogeneously therein, preferably at the grain boundaries, that have a mean particle size of from about 2 to about 100 μm (preferably from about 5 to about 60 μm for diecast alloys and slightly larger for permanent mold cast alloys).

Scanning electron microscopy of the inventive alloys show that the diecast alloys contain Al—Sr—Mg containing second phases approximately 2 to 30 μm long and approximately 1 to 3 μm thick while the permanent mold cast alloys contain Al—Sr—Mg containing second phases approximately 10 to 30 μm long and approximately 2 to 10 μm thick.

Figure 2:
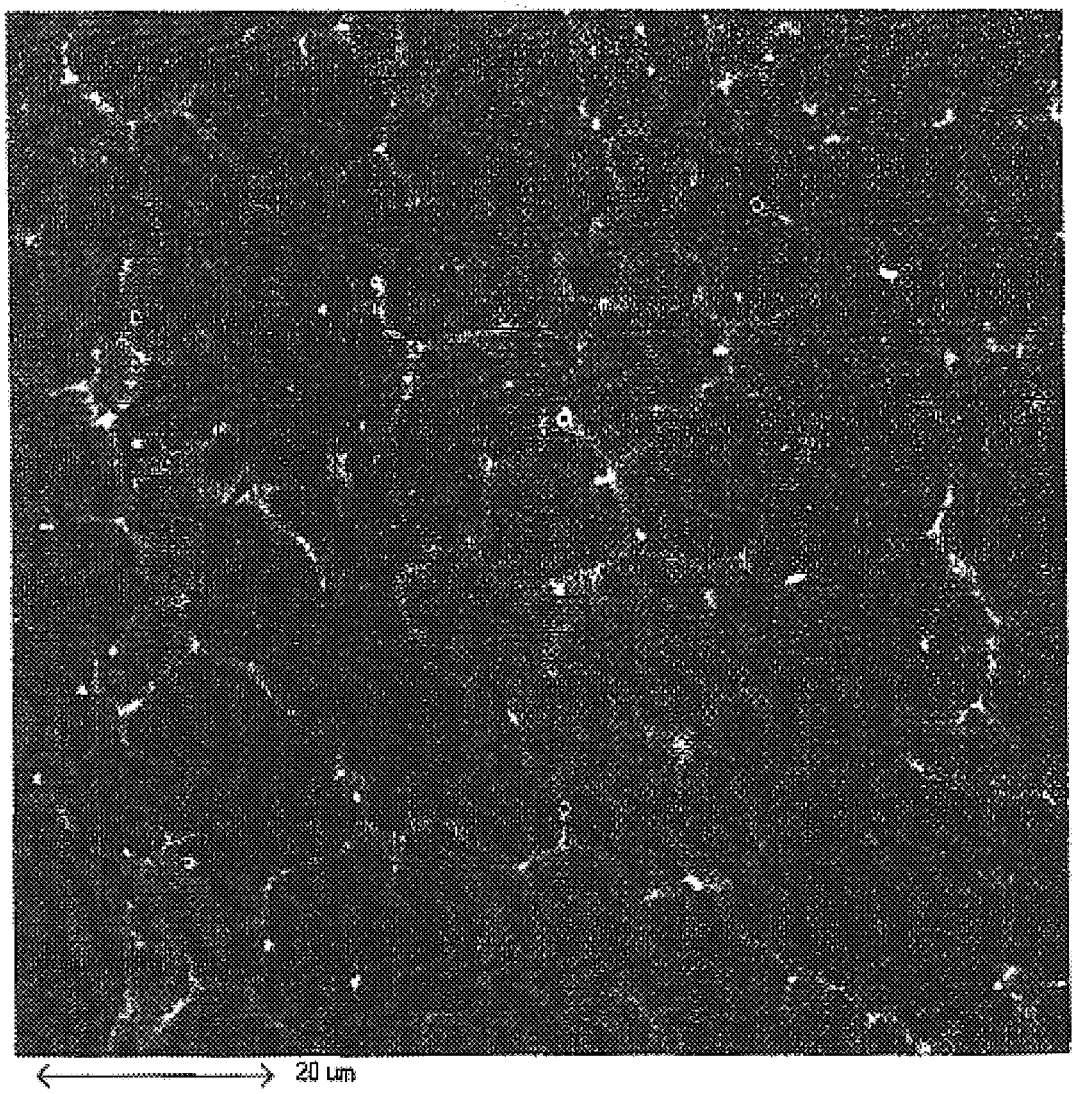
FIG. 2 is a photomicrograph showing the microstructure of another diecast alloy of the present invention, hereinafter referred to as alloy A2.

As best shown by the scanning electron micrographs of FIGS. 1 and 2, the microstructures of inventive diecast alloys A1 and A2, which have a chemical composition as described in Table 1 hereinbelow, contain Al—Sr—Mg containing second phases approximately 25 μm long and 2 μm thick.

Figure 3:
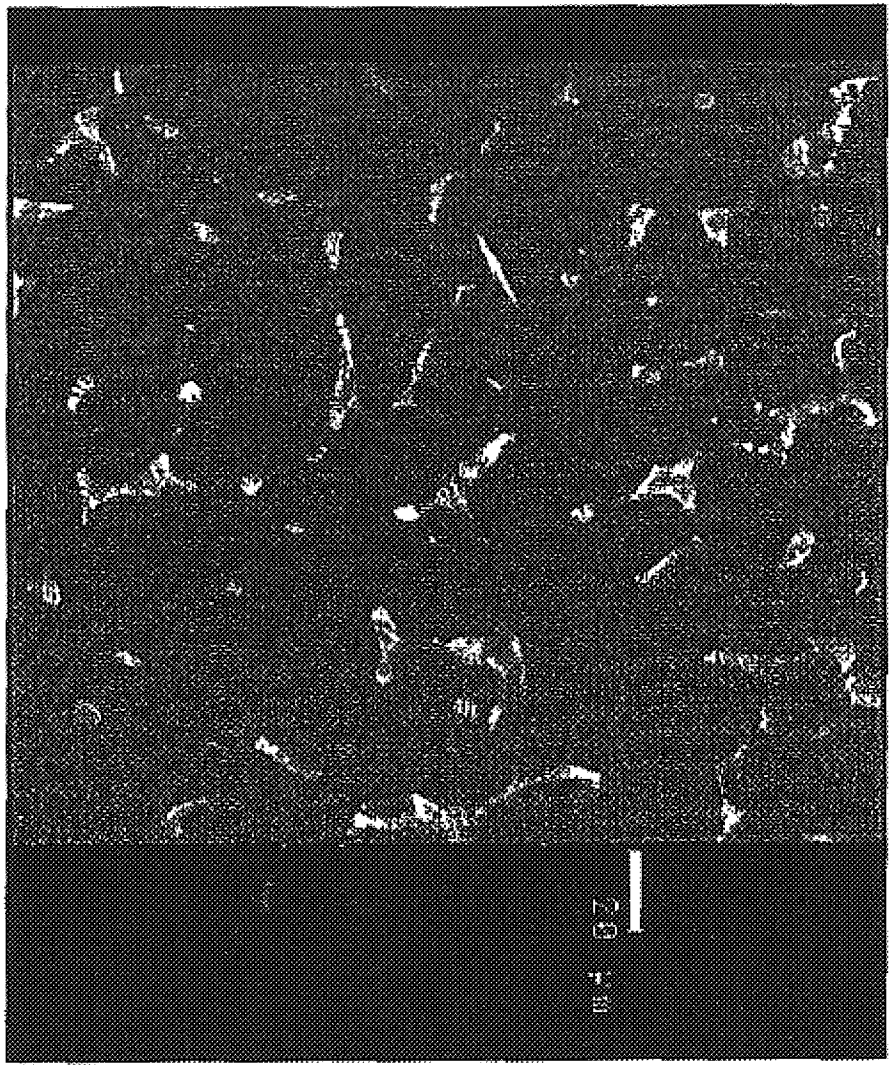
FIG. 3 is a photomicrograph showing the microstructure of permanent mold cast alloy AD9.
Figure 4:
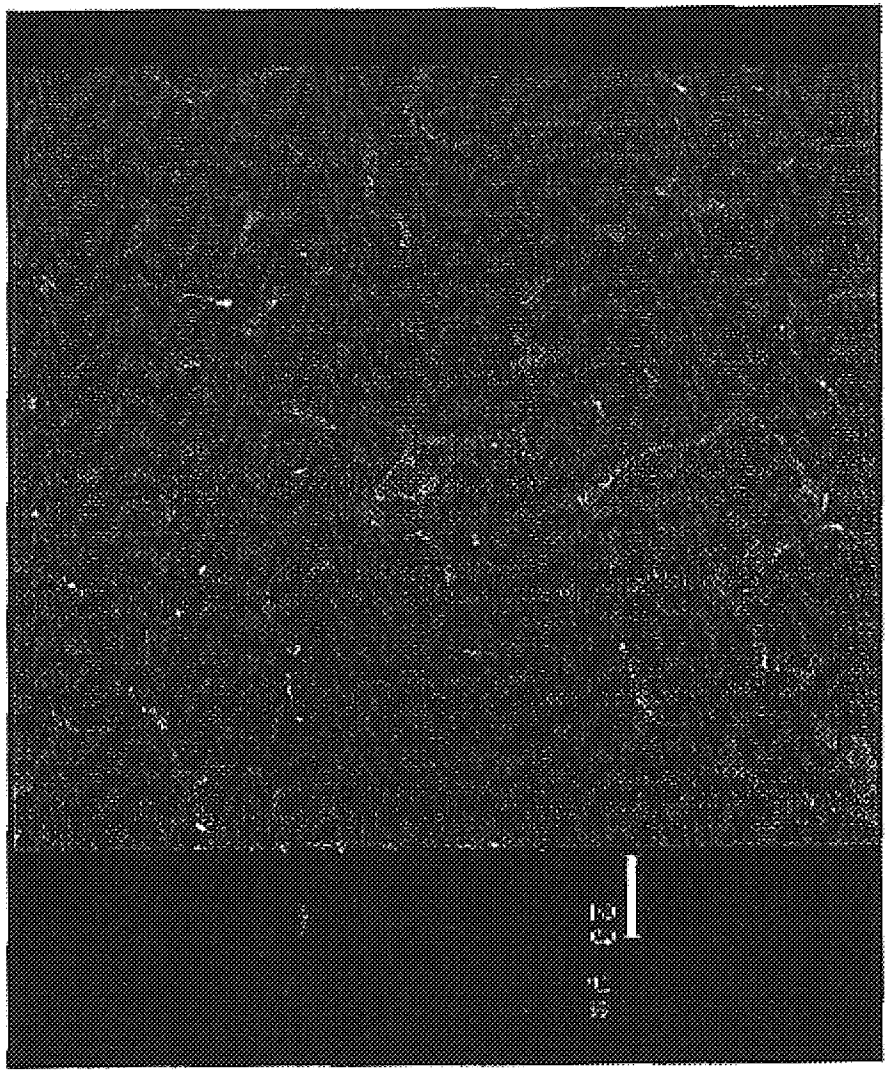
FIG. 4 is a photomicrograph showing the microstructure of permanent mold cast alloy AD10.

As best shown by the scanning electron micrographs of FIGS. 3 and 4, the microstructures of inventive permanent mold cast alloys AD9 and AD10, which have a chemical composition as described in Table 1 hereinbelow, contain Al—Sr—Mg containing second phases approximately 30 μm long and 5 μm thick.

The present invention is described in more detail with reference to the following Examples which are for purposes of illustration only and are not to be understood as indicating or implying any limitation on the broad invention described herein.

WORKING EXAMPLES

| Components Used | |
|---|---|
| AM50 - | a magnesium alloy containing 4.17% by weight of aluminum and 0.32% by weight of manganese obtained from Norsk-Hydro, Bécancour, Québec, Canada. |
| 90-10 Sr—Al - | a strontium-aluminum master alloy containing 90% by weight master alloy strontium and 10% by weight aluminum obtained from Timminco Metals, a division of Timminco Ltd., Haley, Ontario, Canada. |

-continued

| Components Used | |
|---|---|
| AZ91D - | a magnesium alloy containing 8.9 (8.3–9.7)% by weight aluminum, 0.7 (0.35–1.0)% by weight zinc and 0.18 (0.15–0.5)% by weight manganese obtained from Norsk-Hydro. |
| AM50 - | a magnesium alloy containing 4.7 (4.4–5.5)% by weight aluminum and 0.34 (0.26–0.60)% by weight manganese obtained from Norsk-Hydro. |
| AS41 - | a magnesium alloy containing 4.2–4.8 (3.5–5.0)% by weight aluminum and 0.21 (0.1–0.7)% by weight manganese obtained from The Dow Chemical Company, Midland, MI. |
| AM60B - | a magnesium alloy containing 5.7 (5.5–6.5)% by weight aluminum and 0.24 (0.24–0.60)% by weight manganese obtained from Norsk-Hydro. |
| AE42 - | a magnesium alloy containing 3.95 (3.4–4.6)% by weight aluminum and 2.2 (2.0–3.0)% by weight of rare earth elements and a minimum of 0.1% by weight manganese obtained from Magnesium Elektron, Inc., Flemington, NJ. |
| A380 - | an aluminum alloy containing 7.9% by weight silicon and 2.1% by weight zinc obtained from Roth Bros. Smelting Corp., East Syracuse, NY. |

Sample Preparation

Alloys A1 and A2

Two different alloys were prepared by: charging ingots of AM50 into an 800 kilogram (kg) crucible positioned in a Dynarad MS-600 electric resistance furnace; melting the charge; stabilizing the temperature of the melt at 670° C.; and adding 90-10 Sr—Al master alloy to the melt.

The temperature of the melt was maintained at 670° C. for 30 minutes, stirred and then chemical analysis samples taken by pouring equal quantities of the melt into copper spectrometer molds.

The chemical analysis samples were analyzed using ICP mass spectrometry. The chemical composition of the prepared alloys, namely—A1 and A2, are shown in Table 1 hereinbelow. The recovery rate of strontium was determined to be approximately 90%.

The temperature of the melt was cooled to 500° C. while the ICP chemical analysis was carried out on the melt samples. The melt temperature was monitored by both a furnace controller and by a hand-held K-type thermocouple connected to a Fluke-5 1 digital thermometer.

During melting and holding, the melt was protected under a gas mixture of 0.5% $SF_6$-25% $CO_2$, balance air.

The molten metal was die-cast using a 600-tonne Prince (Prince-629) cold-chamber diecasting machine to produce diecast flat-tensile specimens measuring 8.3×2.5×0.3 cm (gage 1.5×0.6 cm), round tensile specimens measuring 10×1.3 cm (gage 2.54×0.6 cm), cylindrical test specimens measuring 4×2.5 cm and corrosion test plates measuring 10×15×0.5 cm.

Operating parameters used for the cold-chamber diecasting machine are shown below.

| Operating Parameters | AZ91D | AS41 | AE42 | AM60 | A380 | A1 | A2 |
|---|---|---|---|---|---|---|---|
| Alloy Temp. (°C.) | 680 | 720 | 750 | 750 | 750 | 720 | 720 |
| Temperature Of Metal Before Injection (°C.) | 250 | 300 | 300 | 300 | 300 | 275 | 275 |
| Pressure (MPa) | 13.8 | 13.8 | 13.8 | 13.8 | 13.8 | 13.8 | 13.8 |
| Piston length (cm) | 3.8/29.2 | 3.8/29.2 | 3.8/29.2 | 3.8/29.2 | 3.8/29.2 | 3.8/29.2 | 3.8/29.2 |
| Base speed (cm/sec) | 28–51 | 28–51 | 28–51 | 28–48 | 28–48 | 28–51 | 28–51 |
| Fast speed (cm/sec) | 384–516 | 315–498 | 368–587 | 417 | 312–330 | 384–516 | 384–516 |
| Average cycle time (sec) | 44–58 | 43–73 | 46–50 | 43 | 42–49 | 44–58 | 44–58 |
| Average die opening time (sec) | 30–44 | 29–54 | 32–36 | 18–29 | 18–35 | 30–44 | 30–44 |
| Die Lubricant | Rdl-188 | Rdl-188 | Rdl-188 | Rdl-188 | Rdl-188 | Rdl-188 | Rdl-3188 |

Alloys AD9–AD14

Six different alloys were prepared by: charging 250 g ingots of AM50 into a 2 kg steel crucible positioned in a Lindberg Blue-M electric resistance furnace; melting the charge; stabilizing the temperature of the melt between 675 and 700° C.; and adding small pieces of 90-10 Sr—Al master alloy to the melt.

The temperature of the melt was maintained at either 675° C. for 30 minutes or at 700° C. for 10 minutes, stirred and then chemical analysis samples taken by pouring equal quantities of the melt into copper spectrometer molds.

The chemical analysis samples were analyzed using ICP mass spectrometry. The chemical composition of the prepared alloys, namely—AD9 to AD14, are shown in Table 1 hereinbelow. The recovery rate of strontium was determined to be 87–92%.

The temperature of the melt was measured by a K-type Chromel-Alumel thermocouple immersed in the melt.

During melting and holding, the melt was protected under a gas mixture of 0.5% $SF_6$, balance $CO_2$.

The molten metal was permanent mold cast using copper permanent molds having mold cavities measuring 3 cm in height with each mold cavity having a top diameter of 5.5 cm and a bottom diameter of 5 cm.

Alloys AC2, AC4, AC6, AC9 and AC10

Five different alloys were prepared in accordance with the test procedure detailed above for Alloys AD9–AD14.

Chemical analysis samples were taken from the melt and analyzed using ICP mass spectrometry. The chemical composition of the prepared alloys, namely—AC2, AC4, AC6, AC9 and AC10, are shown in Table 1 hereinbelow. The recovery rate of strontium was determined to be 87–92%.

The molten metal was permanent mold cast using an H-13 (mild) steel permanent mold. The mold contained cavities for two ASTM standard test bars each measuring 14.2 cm in length and 0.7 cm in depth or thickness. Grip width was 1.9 cm while gage length and gage width was 5.08 cm and 1.27 cm, respectively. The mold was provided with a sprue, riser and gating system to bottom-feed the two tensile bar cavities.

TABLE 1

| | CHEMICAL COMPOSITION | | | | | | | | |
|---|---|---|---|---|---|---|---|---|---|
| ALLOY | Al, wt % | Sr, wt % | Mn, wt % | Zn (ppm) | Fe (ppm) | Cu (ppm) | Ni (ppm) | Si (ppm) | Ca (ppm) |
| AM50 | 5.0 | — | 0.32 | 200 | 20 | 10 | 10 | 70 | 20 |
| 90-10 Sr—Al master alloy | 10 | 90 | | | | | | | |
| A1 | 4.90 | 1.74 | 0.26 | 94 | 23 | 4 | 3 | 34 | 18 |
| A2 | 4.85 | 1.23 | 0.29 | 94 | 11 | 2 | 3 | 47 | 17 |
| AD9 | 4.96 | 0.94 | 0.28 | 56 | <10 | <2 | <2 | — | 17 |
| AD10 | 5.07 | 1.21 | 0.29 | 61 | <10 | <2 | <2 | — | 18 |
| AD11 | 5.00 | 1.54 | 0.28 | 54 | <10 | <2 | <2 | — | 18 |
| AD12 | 5.18 | 2.31 | 0.28 | 54 | <10 | <2 | <2 | — | 18 |
| AD13 | 5.10 | 3.77 | 0.28 | 54 | <10 | <2 | <2 | — | 18 |
| AD14 | 5.71 | 6.89 | 0.28 | 54 | <10 | <2 | <2 | — | 18 |
| AC2 | 4.90 | 1.59 | 0.30 | 43 | 60 | <2 | <2 | — | <10 |
| AC4 | 4.70 | 1.26 | 0.33 | 78 | 84 | 122 | 7 | — | 35 |
| AC6 | 4.89 | 1.22 | 0.32 | 69 | 41 | 127 | 9 | — | 40 |
| AC9 | 4.82 | 1.07 | 0.32 | 42 | 39 | 82 | 3 | — | 31 |
| AC10 | 5.08 | 1.46 | 0.29 | 52 | 39 | 150 | 2 | — | 8 |

Various properties of the alloys were then tested as set forth below and compared against other magnesium alloys and aluminum alloy A380.

Test Methods

The diecast and permanent mold cast test specimens were subjected to the following tests:

Creep Resistance or Creep Extension

The creep resistance of the diecast and permanent mold cast test specimens was measured in accordance with ASTM E139-83. In particular, test specimens were exposed to air for a period of 60 minutes and then subjected, for a period of 200 hr, to a constant stress of 35 MPa via an Applied Test Systems, Inc. (ATS) Lever Arm Tester-2320 creep testing machine while being maintained at a temperature of 150° C. The gage length of each test specimen was then measured and the difference between the original gage length (ie., 1.27 cm) and the gage length of each specimen at the end of the 200 hr test period was determined. The difference in gage length determined for each test specimen was then divided by 1.27 cm and the result reported as a percent (%).

Bolt-Load-Retention or Bolt-Load-Loss

The bolt-load-retention of the diecast test specimens was measured in accordance with the following procedure: diecast cylinders of the alloys were used to machine disc samples measuring 25.4×9 mm. A hole having a diameter of 8.4 mm was then drilled in the middle of each sample. An M8 steel bolt and nut (1.25 pitch) were then screwed with a torque-wrench into each disc sample using a washer of 15.75 mm OD and 8.55 ID and torqued to 265 lbs.in (30 Nm). A special set-up was used to measure the initial angle to which the bolt had to be rotated to reach the prescribed torque.

The special set-up consisted of a 360° mild steel protractor fabricated by the machine shop at Noranda Inc. Technology Center. The protractor had a central hole in the shape of an M10 nut, machined to receive and fix the test specimen in place. A machined M8 socket was used to adapt the hole to an M8 bolt. The protractor was bolted to a table to counteract the rotation force applied during torquing with a digital torque wrench (model Computorq II -64-566 manufactured by Armstrong Tool, USA).

The bolted samples were then immersed in an oil bath having a temperature of 150° C. and were kept in the oil bath for 48 hours where the bolts lost some torque due to stress relaxation. The samples were then removed from the oil bath, cooled to room temperature and the bolts re-tightened to the initial torque of 265 lbs.in (30 Nm). The additional angle required to reach the initial torque was then measured and this value used as a measure of bolt-loosening. The results are reported in degrees (°).

The bolt-load-retention of the permanent mold cast test specimens was measured in accordance with the following procedure: permanent mold cast disc samples of the alloys were machined to discs measuring 35×11 mm. A hole having a diameter of 10.25 was then drilled in the middle of each sample. An M10 steel bolt and nut (1.5 pitch) were then screwed with a torque-wrench into each disc sample using a washer of 19.75 mm OD and 10.75 ID and torqued to 440 lbs.in (50 Nm). A special set-up was used to measure the initial angle to which the bolt had to be rotated to reach the prescribed torque. The set-up was identical to that noted above, except that a machined M8 bolt was not used to adapt the central hole to the M8 bolt. The bolted samples were then immersed in an oil bath having a temperature of 150° C. and were kept in the oil bath for 48 hours where the bolts lost some torque due to stress relaxation. The samples were then removed from the oil bath, cooled to room temperature and the bolts re-tightened to the initial torque of 440 lbs.in (50 Nm). The additional angle required to reach the initial torque was then measured and this value used as a measure of bolt-loosening. The results are reported in degrees (°).

Tensile Properties

Tensile properties (i.e., tensile yield strength, ultimate tensile strength and elongation) at an elevated temperature of 150° C. and at room temperature were measured in accordance with ASTM E8-99 and E21-92. An Instron servovalve hydraulic Universal Testing Machine (model number 8502-1988) equipped with an Instron oven (model number 3116) and an Instron extensiometer (model number 2630-052) were used in conjunction with the subject test methods.

For tensile testing at 150° C., test specimens were clamped within the test assembly and heated to a temperature of 150° C. and then maintained at this temperature for a period of 30 minutes. Specimens were then tested at 0.13 cm/cm/min through yield and at 1.9 cm/min to failure.

For room temperature tensile testing, specimens were tested at 0.7 MPa/min through yield and at 1.9 cm/min to failure.

Tensile yield strength was determined by passing a tangent to the part of the stress-strain curve between 20.5–34.5 MPa and by passing a second line parallel to the one intersecting the y-axis at a 0.2% extension. Results are reported in megapascals (MPa).

Ultimate tensile strength was determined as the stress at rupture or as the maximum stress in the stress-strain curve. Results are reported in MPa.

Elongation was determined by measuring the gage length of each test specimen before and after testing. Results are reported in percent (%).

Salt-Spray Corrosion Resistance

The resistance of the diecast corrosion test plate test specimens to corrosion was measured in accordance with ASTM B117. In particular, specimens were cleaned using a 4% NaOH solution at 80° C., rinsed in cold water and dried with acetone. The specimens were then weighed and then vertically mounted at 20° from the vertical axis within a SINGLETON salt-spray test cabinet (model number SCCH #22). The vertically mounted specimens were then exposed to a 5% NaOH/distilled water fog for a period of 200 hr. During the test period, the fog tower was adjusted to a collection rate of 1 cc/hr and the parameters of the cabinet checked every 2 days. At the end of the 200 hr test period, the specimens were removed, washed in cold water and cleaned in a chromic acid solution (i.e., chromic acid containing silver nitrate and barium nitrate) as per ASTM B117. The samples were then re-weighed and the weight change per sample determined. The results are reported in milligrams per square centimeter per day ($mg/cm^2/day$).

The inventive alloy melts and commercial AZ9ID magnesium alloy melts were subjected to the following test:

Melt Oxidation Resistance

The melt oxidation resistance of the magnesium alloy melts of the present invention and commercial AZ9 ID magnesium alloy melts was determined in accordance with the following method. Alloy ingots weighing 0.5 kg were melted under an inert gas atmosphere comprising a mixture of 0.5% $SF_6$, balance $CO_2$. The melt surface was then skimmed and the melt temperature held at 680–682° C. for 5 hours. The melt surface was then re-skimmed and the weight of the skimmed melt oxides measured using a Mettler PE 16 balance. Percent (%) oxide was determined by dividing the weight of the skimmed melt oxides by the weight of the initial alloy charge.

EXAMPLES 1 AND 2 AND COMPARATIVE EXAMPLES C1 TO C5

In these examples diecast specimens prepared in accordance with the teachings of the present invention and diecast magnesium alloys AZ91D, AE42, AS41 and AM60B and aluminum alloy A380 were tested for creep resistance, bolt-load retention, various tensile properties at both room temperature and at 150° C. and salt-spray corrosion resistance. The results are tabulated in Table 2.

TABLE 2

Summary of Examples 1 and 2 and Comparative Examples C1 to C5

| | EXAMPLE | | | | | | |
|---|---|---|---|---|---|---|---|
| | 1 | 2 | C1 | C2 | C3 | C4 | C5 |
| | ALLOY | | | | | | |
| | A1 | A2 | AZ91D | AE42 | AS41 | AM60B | A380 |
| Properties: Creep Extension (%) at 150° C. | | | | | | | |
| Run 1 | 0.05% | 0.12% | 1.64% | 0.09% | 0.168% | — | 0.192% |
| Run 2 | 0.03% | 0.07% | 0.90% | 0.06% | 0.102% | — | 0.154% |
| Run 3 | 0.02% | 0.02% | 1.08% | 0.05% | 0.12% | — | 0.18% |
| AVERAGE | 0.03% | 0.06% | 1.21% | 0.07% | 0.13% | — | 0.18% |

TABLE 2-continued

Summary of Examples 1 and 2 and Comparative Examples C1 to C5

| | EXAMPLE | | | | | | |
|---|---|---|---|---|---|---|---|
| | 1 | 2 | C1 | C2 | C3 | C4 | C5 |
| | ALLOY | | | | | | |
| | A1 | A2 | AZ91D | AE42 | AS41 | AM60B | A380 |
| Bolt-Load-Loss (°) at 150° C. | | | | | | | |
| Run 1 | 6.0° | 6.0° | 14.0° | 9.0° | 10.5° | — | 2.0° |
| Run 2 | 6.0° | 6.5° | 14.5° | 7.5° | 11.0° | — | 2.0° |
| AVERAGE | 6.0° | 6.3° | 14.3° | 8.3° | 10.8° | — | 2.0° |
| Tensile Properties at 150° C. | | | | | | | |
| Yield Strength (MPa) | | | | | | | |
| Run 1 | 119.9 | 100.8 | 108.2 | 85.4 | 87.7 | | 168.5 |
| Run 2 | 111.1 | 105.0 | 99.5 | 96.2 | 96.3 | | 147.6 |
| Run 3 | 112.8 | 100.0 | 104.4 | 87.2 | 92.0 | | 152.0 |
| Run 4 | 108.5 | 106.0 | — | 85.0 | 98.4 | | 146.5 |
| Run 5 | 106.9 | 100.0 | 106.9 | 89.7 | 89.6 | | 158.6 |
| Run 6 | 100.0 | 96.6 | 106.9 | 82.8 | 89.6 | | 148.2 |
| Run 7 | 103.4 | 96.6 | 103.4 | 86.2 | 93.1 | | 137.9 |
| AVERAGE | 108.9 | 100.7 | 104.9 | 87.5 | 92.4 | | 151.3 |
| Ultimate Tensile Strength (MPa) | | | | | | | |
| Run 1 | 188.3 | 150.8 | 179.9 | 139.0 | 154.0 | | 293.0 |
| Run 2 | 168.1 | 143.3 | 161.6 | 162.6 | 153.0 | | 235.7 |
| Run 3 | 171.1 | 149.7 | 174.3 | 152.3 | 155.3 | | 264.3 |
| Run 4 | 161.1 | 157.9 | — | 143.5 | 147.9 | | 259.9 |
| Run 5 | 158.6 | 148.3 | 169.0 | 137.9 | 144.8 | | 251.7 |
| Run 6 | 158.6 | 144.8 | 169.0 | 127.6 | 137.9 | | 255.1 |
| Run 7 | 151.7 | 148.3 | 165.5 | 137.9 | 155.1 | | 220.6 |
| AVERAGE | 165.4 | 149.0 | 169.9 | 143.0 | 149.7 | | 254.3 |
| Elongation % | | | | | | | |
| Run 1 | 11.7 | 19.3 | 20.6 | 16.1 | 19.8 | | 4.4 |
| Run 2 | 8.0 | 9.2 | 12.5 | 24.4 | 20.4 | | 3.1 |
| Run 3 | 22.0 | 17.6 | 12.6 | 30.2 | 19.5 | | 7.5 |
| Run 4 | 8.2 | 24.9 | — | 25.6 | 7.4 | | 7.5 |
| Run 5 | 22.1 | 11.7 | 19.5 | 21.6 | 17.6 | | 4.5 |
| Run 6 | 14.3 | 23.4 | 11.7 | 22.3 | 16.7 | | 7.9 |
| Run 7 | 7.8 | 19.5 | 19.5 | 24.6 | 17.8 | | 4.5 |
| AVERAGE | 13.4% | 17.9% | 16% | 23.5% | 17% | | 6.7% |
| Tensile Properties at Room Temperature | | | | | | | |
| Yield Strength (MPa) | | | | | | | |
| Run 1 | 136.7 | 136.6 | 154.1 | 132.0 | 118.1 | | 141.9 |
| Run 2 | 146.0 | 136.2 | 156.9 | 131.5 | 139.3 | | 157.8 |
| Run 3 | 139.7 | 136.2 | 150.8 | 130.9 | 136.8 | | 160.6 |
| Run 4 | 146.6 | 136.0 | 154.8 | 131.2 | 135.7 | | 156.4 |
| Run 5 | 136.2 | 135.3 | — | 131.0 | 129.6 | | 155.9 |
| Run 6 | 151.7 | 141.4 | 162.1 | 137.9 | 148.2 | | 162.0 |
| Run 7 | 144.8 | 137.9 | 158.6 | 137.9 | 151.7 | | 148.2 |
| Run 8 | 148.3 | 141.4 | 158.6 | 137.9 | 131.0 | | 158.6 |
| AVERAGE | 143.7 | 137.6 | 156.6 | 133.8 | 123.8 | | 155.2 |
| Ultimate Tensile Strength (MPa) | | | | | | | |
| Run 1 | 206.8 | 228.0 | 257.0 | 240.3 | 255.4 | | 247.4 |
| Run 2 | 215.5 | 223.1 | 249.4 | 221.6 | 231.0 | | 233.0 |
| Run 3 | 215.3 | 236.5 | 220.7 | 212.8 | 241.5 | | 332.5 |
| Run 4 | 222.9 | 228.5 | 231.5 | 240.3 | 254.6 | | 312.1 |
| Run 5 | 241.6 | 238.2 | — | 240.7 | 262.6 | | 323.5 |
| Run 6 | 186.2 | 231.0 | 231.0 | 206.9 | 196.5 | | 310.3 |
| Run 7 | — | 234.5 | 227.6 | 227.6 | 217.2 | | 251.7 |
| Run 8 | 193.1 | 241.4 | 248.3 | 224.1 | 231.0 | | 317.2 |
| AVERAGE | 211.6 | 232.7 | 237.9 | 226.8 | 236.3 | | 291.0 |
| Elongation % | | | | | | | |
| Run 1 | 3.7 | 7.6 | 5.6 | 13.2 | 11.0 | | 1.8 |
| Run 2 | 4.1 | 6.4 | 4.4 | 8.3 | 5.4 | | 1.7 |
| Run 3 | 5.0 | 9.2 | 3.6 | 5.6 | 8.0 | | 4.7 |
| Run 4 | 5.0 | 8.2 | 3.5 | 12.4 | 9.8 | | 4.0 |
| Run 5 | 7.9 | 8.4 | 4.3 | 10.2 | 10.1 | | 3.0 |
| Run 6 | 3.7 | 6.2 | 5.0 | 6.2 | 3.3 | | 4.4 |
| Run 7 | 2.5 | 11.2 | 5.0 | 10.0 | 4.4 | | 2.2 |
| Run 8 | 2.5 | 11.2 | 6.2 | 8.7 | 7.8 | | 3.4 |
| AVERAGE | 4.3% | 8.6% | 4.7% | 9.3% | 7.4% | | 3.2% |

TABLE 2-continued

| Summary of Examples 1 and 2 and Comparative Examples C1 to C5 | | | | | | | |
|---|---|---|---|---|---|---|---|
| | EXAMPLE | | | | | | |
| | 1 | 2 | C1 | C2 | C3 | C4 | C5 |
| | ALLOY | | | | | | |
| | A1 | A2 | AZ91D | AE42 | AS41 | AM60B | A380 |
| Salt-Spray Corrosion Rate (mg/cm$^2$/day) | | | | | | | |
| Run 1 | 0.104 | 0.119 | 0.127 | 0.172 | 0.019 | 0.307 | 0.322 |
| Run 2 | 0.097 | 0.105 | 0.097 | 0.251 | 0.174 | 0.236 | 0.330 |
| Run 3 | 0.057 | 0.197 | 0.085 | 0.144 | 0.317 | 0.175 | 0.380 |
| AVERAGE | 0.086 | 0.155 | 0.103 | 0.189 | 0.170 | 0.260 | 0.344 |

A review of the average creep extension, bolt-load-loss, tensile properties and salt-spray corrosion rate values in Table 2 indicates that the magnesium-based casting alloys of the present invention have improved overall elevated temperature performance as compared to magnesium alloys AZ91D, AE42, AS41 and AM60B and aluminum alloy A380.

EXAMPLES 3 TO 8 AND COMPARATIVE EXAMPLES C6 TO C10

In these examples permanent mold cast disc specimens prepared in accordance with the present invention and permanent mold cast magnesium alloys AZ91D, AM50, AS41 and AE42 and aluminum alloy A380 were tested for bolt-load retention. The results are tabulated in Table 3.

TABLE 3

| Summary of Examples 3 to 8 and Comparative Examples C6 to C10 | | | | | | | | | | | |
|---|---|---|---|---|---|---|---|---|---|---|---|
| | EXAMPLE | | | | | | | | | | |
| | 3 | 4 | 5 | 6 | 7 | 8 | C6 | C7 | C8 | C9 | C10 |
| | ALLOY | | | | | | | | | | |
| | AD90 | AD10 | AD11 | AD12 | AD13 | AD14 | AZ91D | AM50 | AS41 | AE42 | A380 |
| Properties: Bolt-Load-Loss (°) | | | | | | | | | | | |
| Run 1 | 3.25° | 2.5° | 2.5° | 4.5° | 2.0° | 2.0° | 9.5° | 4.75° | 3.0° | 3.0° | 2.0° |
| Run 2 | 2.75° | 3.0° | 3.0° | 3.0° | 2.5° | 2.0° | 9.5° | 7.5° | 6.0° | 3.0° | 2.0° |
| Run 3 | — | — | — | — | — | — | 8.5° | 7.0° | — | 4.5° | — |
| Run 4 | — | — | — | — | — | — | 9.5° | 7.5° | — | 3.5° | — |
| Run 5 | — | — | — | — | — | — | 8.5° | — | — | 7.0° | — |
| AVERAGE | 3.0° | 2.75° | 2.75° | 3.75° | 2.25° | 2.0° | 9.1° | 6.7° | 4.5° | 4.2° | 2.0° |

In particular, Examples 1 and 2 demonstrated improved creep resistance over comparative Examples C1(AZ91D), C2(AE42) and C5(A380) and better bolt-load retention (smaller angle of loss) than Comparative Examples C1 to C3(AZ91D, AE42 and AS41).

In terms of tensile properties, Examples 1 and 2 demonstrated improved yield strength (at room temperature and at 150° C.) over Comparative Examples C2(AE42) and C3(AS41) and improved elongation (at room temperature and at 150° C.) over Comparative Example C5(A380).

Examples 1 and 2 further demonstrated improved salt-spray corrosion resistance over Comparative Examples C2(AE42), C3(AS41), C4(AM60B) and C5(A380) and comparable salt-spray corrosion resistance to that demonstrated by Comparative Example C1(AZ91D).

By way of the average bolt-load-loss values shown in Table 3, it can be seen that the permanent mold cast alloys of the present invention (i.e., Examples 3 to 8) demonstrate improved bolt-load retention (smaller angle of loss) when compared to magnesium alloys AZ91D, AM50, AS41 and AE42 (i.e., C6 to C9) and comparable bolt-load retention to that demonstrated by aluminum alloy A380 (i.e., C10).

EXAMPLES 9 TO 12 AND COMPARATIVE EXAMPLES C11 TO C13

In these examples permanent mold cast ASTM standard flat tensile specimens prepared in accordance with the present invention and permanent mold cast magnesium alloys AZ91D and AE42 and aluminum alloy A380 were tested for creep resistance. The results are tabulated in Table 4.

TABLE 4

Summary of Examples 9 to 12 and Comparative Examples C11 to C13

| | EXAMPLE | | | | | | |
|---|---|---|---|---|---|---|---|
| | 9 | 10 | 11 | 12 | C11 | C12 | C13 |
| | ALLOY | | | | | | |
| | AC9 | AC4 | AC6 | AC10 | AZ91D | AE42 | A380 |
| Properties: | | | | | | | |
| Creep Extension (%) at 150° C. | | | | | | | |
| Run 1 | 0.012% | 0.006% | 0.0215% | 0.03% | 0.136% | 0.035% | 0.092% |
| Run 2 | — | — | 0.029% | — | — | 0.014% | 0.099% |
| AVERAGE | 0.01% | 0.01% | 0.03% | 0.03% | 0.136% | 0.03% | 0.096% |

By way of the average creep extension values shown in Table 4, it can be seen that the permanent mold cast alloys of the present invention (i.e., Examples 9 to 12) demonstrate improved creep resistance at 150° C. when compared to magnesium alloys AZ91D and A380 (i.e., C11 and C13) and comparable creep resistance to that demonstrated by magnesium alloy AE42 (i.e., C12).

EXAMPLES 13 TO 16 AND COMPARATIVE EXAMPLES C14 TO C16

In these examples permanent mold cast ASTM standard flat tensile specimens prepared in accordance with the present invention and permanent mold cast magnesium alloys AZ91D and AE42 and aluminum alloy A380 were tested for tensile properties at 150° C. The results are tabulated in Table 5.

TABLE 5

Summary of Examples 13 to 16 and Comparative Examples C14 to C16

| | EXAMPLE | | | | | | |
|---|---|---|---|---|---|---|---|
| | 13 | 14 | 15 | 16 | C14 | C15 | C16 |
| | ALLOY | | | | | | |
| | AC9 | AC6–AC4 | AC10 | AC2 | AZ91D | AE42 | A380 |
| Properties: | | | | | | | |
| Tensile Properties at 150° C. | | | | | | | |
| Yield Strength (MPa) | | | | | | | |
| Run 1 | 56.5 | 59.3 | 62.0 | 69.7 | 81.2 | 43.9 | 124.3 |
| Run 2 | 58.6 | 66.7 | 62.1 | 62.9 | 78.7 | 48.0 | 126.4 |
| Run 3 | — | 66.5 | — | — | 79.4 | 43.4 | — |
| Run 4 | — | — | — | — | 93.1 | 44.8 | — |
| AVERAGE | 57.6 | 64.2 | 62.1 | 66.3 | 83.1 | 45.0 | 125.4 |
| Ultimate Tensile Strength (MPa) | | | | | | | |
| Run 1 | 118.0 | 96.4 | 100.0 | 95.5 | 169.9 | 111.0 | 187.5 |
| Run 2 | — | 95.5 | 117.2 | 99.9 | 176.7 | 113.2 | 162.4 |
| Run 3 | — | 89.7 | | — | 166.5 | 113.4 | — |
| Run 4 | — | | | — | 162.1 | 117.2 | — |
| AVERAGE | 118.0 | 93.9 | 108.6 | 97.70 | 168.8 | 113.6 | 175.0 |
| Elongation % | | | | | | | |
| Run 1 | 5.7 | 4.6 | 3.1 | 1.9 | 5.6 | 10.5 | 1.3 |
| Run 2 | — | — | 5.5 | 2.6 | 11.0 | 11.3 | 0.9 |
| Run 3 | — | 2.5 | — | — | 8.7 | 11.0 | — |
| Run 4 | — | — | — | — | 9.0 | 3.0 | — |
| AVERAGE | 5.7% | 3.6% | 4.3% | 2.3% | 8.6% | 9.0% | 1.1% |

By way of the average tensile properties values shown in Table 5, it can be seen that the permanent mold cast alloys of the present invention (i.e., Examples 13 to 16) demonstrate improved yield strength at 150° C. when compared to magnesium alloy AE42 (i.e., C15).

EXAMPLE 17 AND COMPARATIVE EXAMPLE C17

In these examples, an alloy melt according to the present invention and an AZ91D magnesium alloy melt were tested for melt oxidation resistance. The chemical compositions of these alloy melts and the melt oxidation resistance test results, are shown in Table 6.

TABLE 6

Summary of Example 17 and Comparative Example C17

| EXAMPLE | 17 | C17 |
|---|---|---|
| ALLOY | Mg-5Al-2Sr | AZ91D |
| Chemical Compositions | | |
| Al, wt % | 5.2 | 8.55 |
| Sr, wt % | 2.1 | |
| Mn, wt % | 0.47 | 0.23 |
| Zn (ppm) | 0.01 | 0.72 |
| Fe (ppm) | 30 | 6 |
| Cu (ppm) | 2 | 2 |
| Ni (ppm) | 6 | 6 |
| Si (ppm) | 0.03 | 0.0246 |
| Be (ppm) | 4 | 9 |
| Melt Oxidation Resistance | | |
| Actual Charge (g) | 558 | 549.90[1] |
| Weight of Skimmed Oxides (g) | 3.74 | 11.07[1] |
| % Oxide[2] | 0.67 | 2.0 |

[1]Average of three runs.
[2][Weight of Skimmed Oxides/Actual Charge] × 100.

A review of the melt oxidation resistance values shown in Table 6, indicates that the alloy melt of the present invention (i.e., Example 17), when melted under a $CO_2/SF_6$ protective-gas atmosphere, demonstrates an exceptional resistance to oxidation, which is significantly higher than that demonstrated by AZ91D commercial magnesium alloy melts (i.e., Comparative Example C17).

Having thus described the invention, what is claimed is:

1. A method of making an oxidation-resistant alloy melt, wherein said alloy melt comprises, in weight percent of alloying metals, 2 to 9% aluminum, 1 to 7% strontium, 0 to 0.60% manganese, and 0 to 0.35% zinc, with the balance being magnesium except for impurities commonly found in magnesium alloys, wherein said method comprises: melting said alloying metals under an atmosphere of an inert gas selected from a mixture of carbon dioxide and sulfur fluoride gas, a mixture of nitrogen and sulfur dioxide gas, and combinations thereof.

2. A method of making a magnesium-based alloy casting from an oxidation-resistant alloy melt, wherein said alloy comprises, in weight percent of alloying metals, 2 to 9% aluminum, 1 to 7% strontium, 0 to 0.60% manganese, and 0 to 0.35% zinc, with the balance being magnesium except for impurities commonly found in magnesium alloys, and wherein said method comprises: melting said alloying metals under an atmosphere of an inert gas selected from a mixture of carbon dioxide and sulfur fluoride gas, a mixture of nitrogen and sulfur dioxide gas, and combinations thereof.

3. The method of claim 2, wherein said alloy has a structure including a matrix of grains of magnesium having a mean particle size of from about 10 to about 200 micrometers reinforced by intermetallic compounds having a mean particle size of from about 2 to about 100 micrometers.

4. An oxidation-resistant alloy melt, wherein said alloy melt comprises, in weight percent of alloying metals, 2 to 9% aluminum. 1 to 7% strontium, 0 to 0.60% manganese, and 0 to 0.35% zinc, with the balance being magnesium except for impurities commonly found in magnesium alloys, wherein said alloy melt is prepared by a method comprising: melting said alloying metals under an atmosphere of an inert gas selected from a mixture of carbon dioxide and sulfur fluoride gas, a mixture of nitrogen and sulfur dioxide gas, and combinations thereof.

5. The oxidation-resistant alloy melt of claim 4, wherein said alloy melt comprises, in weight percent, 2 to 9% aluminum, 1 to to 5% strontium, 0 to 0.60% manganese, and 0 to 0.35% zinc, with the balance being magnesium except for impurities commonly found in magnesium alloys.

6. The oxidation-resistant alloy melt of claim 5, wherein said alloy melt consists essentially of, in weight percent, 2 to 9% aluminum, 1 to 3% strontium, 0 to 0.60% manganese, and 0 to 0.35% zinc, with the balance being magnesium except for impurities commonly found in magnesium alloys.

7. The oxidation-resistant alloy melt of claim 6, wherein said alloy melt consists of, in weight percent, 4.0 to 6.0% aluminum, 1 to 3% strontium, 0.25 to 0.35% manganese, and 0 to 0.10% zinc, with the balance being magnesium except for impurities commonly found in magnesium alloys.

8. A magnesium-based alloy casting prepared from an oxidation-resistant alloy melt, wherein said alloy comprises, in weight percent of alloying metals, 2 to 9% aluminum, 1 to 7% strontium, 0 to 0.60% manganese, and 0 to 0.35% zinc, with the balance being magnesium except for impurities commonly found in magnesium alloys, and wherein said alloy melt is prepared by a method comprising: melting said alloying metals under an atmosphere of an inert gas selected from a mixture of carbon dioxide and sulfur fluoride gas, a mixture of nitrogen and sulfur dioxide gas, and combinations thereof.

9. The magnesium-based alloy casting of claim 8, wherein said alloy has a structure including a matrix of grains of magnesium having a mean particle size of from about 10 to about 200 micrometers reinforced by intermetallic compounds having a mean particle size of from about 2 to about 100 micrometers.

* * * * *